US008833018B2

(12) United States Patent
Reinecke

(10) Patent No.: US 8,833,018 B2
(45) Date of Patent: Sep. 16, 2014

(54) MOUNTING SYSTEM AND METHOD FOR MOUNTING A DIVIDING WALL ON A HOLDING DEVICE, AND DEVICE FOR DIVIDING REGIONS

(75) Inventor: Peter Reinecke, Numbrecht (DE)

(73) Assignee: KL MEGLA GmbH, Eitorf (DE)

( * ) Notice: Subject to any disclaimer, the term of this patent is extended or adjusted under 35 U.S.C. 154(b) by 0 days.

(21) Appl. No.: 13/510,866

(22) PCT Filed: Nov. 18, 2010

(86) PCT No.: PCT/EP2010/067785

§ 371 (c)(1),
(2), (4) Date: May 18, 2012

(87) PCT Pub. No.: WO2011/061273

PCT Pub. Date: May 26, 2011

(65) Prior Publication Data

US 2012/0227339 A1 Sep. 13, 2012

(30) Foreign Application Priority Data

Nov. 20, 2009 (DE) ..... 10 2009 046 944

(51) Int. Cl.
*E04H 1/00* (2006.01)
*E04B 2/74* (2006.01)

(52) U.S. Cl.
CPC ..... *E04B 2/7425* (2013.01)
USPC ..... 52/239; 52/282.1; 403/122; 248/181.1

(58) Field of Classification Search
USPC ..... 52/239, 243, 282.1, 282.2; 160/135; 256/24–31; 403/122–144; 248/181.1, 248/181.2, 183.2, 121, 309.1, 534, 539, 248/540, 535
See application file for complete search history.

(56) References Cited

U.S. PATENT DOCUMENTS 6,519,903 B1 2/2003 Dirisamer et al.
8,371,460 B2 * 2/2013 Ghatikar et al. ..... 211/175

FOREIGN PATENT DOCUMENTS

DE 3122942 A1 12/1982
DE 8333442 U1 3/1984

(Continued)

OTHER PUBLICATIONS

Internation Preliminary Report on Patentability for PCT/EP2010/067785 to KL Megla GmbH, 13 pages, Jun. 6, 2012, English Translation.

(Continued)

*Primary Examiner* — William Gilbert
*Assistant Examiner* — Gisele Ford
(74) *Attorney, Agent, or Firm* — Hodgson Russ

(57) ABSTRACT

The invention relates to a mounting system and to a method for mounting a dividing wall (1) on at least one holding device (2, 3), for example a holding rod or a holding post. Furthermore, the invention relates to a device for dividing regions. To this end, a first mounting device (23 to 28) which can be mounted on the holding device (2, 3) and a second mounting device (23 to 28) which can be mounted on the holding device (2, 3) are used. Furthermore, a mounting element (35) is provided which can be mounted on the first mounting device (23 to 28) and has a receptacle (36), in which a dividing wall (1) can be received in a non-clamping manner. Moreover, a clamping holder (4 to 9) is used, wherein the clamping holder (4 to 9) can be mounted on the second mounting device (23 to 28), wherein the clamping holder (4 to 9) has a first clamping part (12) and a second clamping part (18), and wherein the first clamping part (12) and the second clamping part (18) are designed so as to hold a dividing wall (1) between them in a clamping manner.

9 Claims, 11 Drawing Sheets

(56) References Cited

FOREIGN PATENT DOCUMENTS

| | | | |
|---|---|---|---|
| DE | 3531674 | A1 | 3/1986 |
| DE | 3702128 | A1 | 8/1988 |
| DE | 3927653 | A1 | 3/1991 |
| DE | 9202301 | U1 | 7/1993 |
| DE | 4418741 | A1 | 11/1995 |
| DE | 29515491 | U1 | 2/1996 |
| DE | 19541810 | A1 | 5/1997 |
| DE | 19809617 | A1 | 10/1999 |
| DE | 20111212 | U1 | 12/2001 |
| DE | 20304681 | U1 | 9/2003 |
| DE | 102005051103 | A1 | 4/2007 |
| DE | 102009051103 | A1 | 9/2010 |
| EP | 0677349 | B2 | 5/2001 |
| EP | 2017399 | A1 | 1/2009 |
| FR | 87431 | E | 8/1966 |
| GB | 2364109 | A | 1/2002 |
| WO | 93/17248 | A1 | 9/1993 |

OTHER PUBLICATIONS

International Preliminary Report on Patentability for PCT/EP2010/067785 to KL Megla GmbH, Jun. 12, 2012, 13 pages.

* cited by examiner

B-B

A-A

A-A

MOUNTING SYSTEM AND METHOD FOR MOUNTING A DIVIDING WALL ON A HOLDING DEVICE, AND DEVICE FOR DIVIDING REGIONS

The invention relates to a mounting system for mounting a dividing wall, in particular a glass wall, on at least one holding device, for example a holding rod or a holding post. The invention furthermore relates to a method for mounting a dividing wall on a holding device. The invention moreover relates to an apparatus for dividing regions.

Dividing walls, in particular glass walls, are used in numerous embodiments and with various functions. Examples include dividing walls which are designed as glass panels and are used for balcony borders. Dividing walls are also used, for example, as banisters. Furthermore, dividing walls, in particular dividing walls made of glass, are used for separating off areas in office rooms, sales rooms, recreation halls and/or sports halls.

In order to arrange a dividing wall on a post, it is known to make use of a clamping device which is fastenable both to the dividing wall and to the post. The clamping device has a first clamping part and a second clamping part which have insides with adjacent pads made of an elastic material. Said pads rest against the dividing wall when the dividing wall is clamped between the first clamping part and the second clamping part. For this purpose, the first clamping part and the second clamping part are braced against each other by means of at least one clamping screw. Furthermore, the known clamping device has a base part which is screwable onto a post or the like by means of a fastening screw. The known clamping device is suitable for fastening a dividing wall made of glass between two holding devices in the form of posts.

With regard to the prior art, reference is made by way of example to DE 35 31 674 A1 and to DE 83 33 442 U1.

It has turned out that, in order to mount a dividing wall of this type, in particular a glass panel, onto a holding device (for example a post) by means of the known clamping device, a number of people are generally required. At least a first person is required in order to hold the dividing wall while a second person is required to fasten the clamping device to the dividing wall and the holding device. This is disadvantageous, since the costs for mounting the dividing wall are fairly high because of the required outlay on labor.

The invention is therefore based on the object of indicating a system and a method for mounting a dividing wall, in particular a glass panel, and an apparatus for separating regions, with the aid of which the mounting of a glass wall between two holding devices is possible in a simple manner.

According to the invention, this object is achieved by a mounting system with the features of claim 1. A mounting apparatus of the invention is provided by the features of claim 11. The invention furthermore also relates to a method for mounting a dividing wall by means of the mounting system, wherein the method has the features of claim 12. An apparatus according to the invention for dividing regions is provided by the features of claim 14. Further features of the invention emerge from the following description, the claims and/or the attached figures.

The mounting system according to the invention serves for mounting a dividing wall, in particular a glass wall or a glass panel, on at least one holding device, for example a holding post or a holding rod. The mounting system is provided in particular to securely fasten a dividing wall between two holding devices in the form of posts in a simple manner. The mounting system has at least one first mounting device which is mountable on the holding device. Furthermore, at least one second mounting device which is likewise mountable on the holding device is provided. The mounting system according to the invention furthermore has at least one mounting element which is mountable on the first mounting device. The mounting element in turn has a receptacle, in which a dividing wall is receivable in a non-clamping manner. Expressed in other words, a dividing wall which is received in the receptacle is guided, but is not clamped, by the mounting element. Clamping, i.e. fixing, of a dividing wall in such a manner that the latter can no longer be moved is not possible by the mounting element. This differentiates the mounting element of the mounting system according to the invention from a clamping device which is known from the prior art and in which a dividing wall is clamped and fixed between two clamping parts such that said dividing wall can no longer move.

Furthermore, at least one clamping holder is provided in the mounting system according to the invention, wherein the clamping holder is mountable on the second mounting device. The clamping holder has a first clamping part and a second clamping part, wherein the first clamping part and the second clamping part are designed so as to hold a dividing wall in a clamping manner therebetween. In this respect, the above mentioned clamping holder of the mounting system according to the invention corresponds in the function thereof to a clamping device known from the prior art.

The invention has the advantage that, owing to the mounting element, it is possible in a simple manner first of all to fix a dividing wall in a releasable manner and to arrange said dividing wall at a predeterminable position. The clamping holder can then be arranged on the dividing wall and the holding device in such a manner that the dividing wall is connected securely and fixedly to the holding device. The mounting system according to the invention ensures that a dividing wall can be mounted on a holding device by means of a clamping holder in a simple manner by just one individual person. A number of people are no longer required for the mounting of the dividing wall. This will be discussed in more detail further below.

The invention also has the advantage that the individual components can be manufactured as standard components and as series parts which, in addition, are then easily assemblable in order to separate off regions by means of a dividing wall. The production as standard components and series parts is advantageous, since the costs of producing parts of this type are low.

In an embodiment of the mounting system according to the invention, the receptacle of the mounting element is additionally or alternatively designed in such a manner that the mounting element is displaceable along a dividing wall, which is receivable or received in the receptacle. In addition or as an alternative for this purpose, it is provided that the receptacle is of U-shaped design. It has in particular a first limb, a second limb and a base which is arranged between the first limb and the second limb. A dividing wall arranged in the receptacle is indeed surrounded by the first limb and the second limb, but—as already explained above—not in a clamping manner. It is merely ensured that the dividing wall is guided and is not inadvertently removable from the receptacle of the mounting element.

In a further embodiment of the mounting system according to the invention, the mounting element additionally or alternatively has at least one holding element which is designed for arranging the mounting element on the first mounting device. For example, it is provided that the holding element is designed as a recess in which the first mounting device can be arranged. In one embodiment, it is provided, for example, that the holding element has at least one guide receptacle and/or a holding element section formed with a radius. For example, it is provided that the guide receptacle is of slot-shaped design and that the slot-shaped guide receptacle has a holding element section which is of spherical design and in which a spherical head of the first mounting device can be arranged.

In a further embodiment of the invention, the mounting element is additionally or alternatively of integral design. For example, said mounting element is formed from a plastic. However, it is explicitly emphasized that the invention is not restricted to single-piece mounting elements. On the contrary, use may also be made of mounting elements which are of multi-part design.

In a further embodiment of the mounting system according to the invention, the first mounting device is additionally or alternatively of rod-shaped design. Additionally or alternatively thereto in turn, the second mounting device is of rod-shaped design. In a further embodiment of the invention, it is additionally or alternatively provided thereto that the first mounting device has a first end which is provided with a radius. For example, the first mounting device is designed with a first spherically headed end. Alternatively or additionally thereto, the second mounting device has a second end which is provided with a second radius. In particular, it is provided that the second mounting device has a second spherically headed end. The first end or the first spherically headed end of the first mounting device is provided in order to be received in the holding element section of the mounting element. Additionally or alternatively thereto, it is provided that the first end or the first spherically headed end of the first mounting device can be arranged in a corresponding holding section of the clamping holder. The above also applies correspondingly to the second end or the second spherically headed end of the second mounting device. The second end or the second spherically headed end of the second mounting device is designed so as to be received in the holding element section of the mounting element. Additionally or alternatively thereto, it is provided that the second end or the second spherically headed end of the second mounting device can be arranged in a corresponding holding section of the clamping holder. The design as the spherical head and the corresponding complementary design for receiving the spherical head on the clamping holder makes it possible for the clamping holder to be able to be arranged at different angles with respect to a preferred alignment of the first mounting device or of the second mounting device. This ensures a high degree of flexibility in the alignment and arrangement of the dividing wall. It is basically possible, by means of the apparatus according to the invention, to precisely reproduce the profile of a boundary line of a region to be divided off, i.e. to guide the apparatus precisely along the boundary line, specifically irrespective of the geometrical shape of the boundary line.

It is explicitly pointed out that the first end of the first mounting device and/or the second end of the second mounting device may also have a different design from a spherical head. For example, at least one of the ends (i.e. the first end and the second end) may be of conical, cylindrical and/or elliptical design.

In a further embodiment of the mounting system according to the invention, the first mounting device additionally or alternatively has a first mounting opening for the engagement of a tool. Additionally or alternatively thereto, it is provided that the second mounting device has a second mounting opening for the engagement of a tool. The first mounting opening and the second mounting opening is there for the engagement of a tool in such a manner that the first mounting device and/or the second mounting device can be fastened to the holding device. For example, the first mounting device is screwed into the holding device. In order to be able to carry out a screwing movement, a pin, for example, is introduced into the first mounting opening and the first mounting device is screwed to the holding device. The same applies correspondingly to the second mounting device.

In an, in turn, further exemplary embodiment of the mounting system according to the invention, the mounting system additionally or alternatively comprises a drilling template usable for producing the bores for fastening the holding device to a floor. For example, the drilling template is placed onto the floor and the bores are then produced by means of the drilling template. The drilling template ensures that the bores are arranged in such a manner that the holding device, for example a holding post, can easily be fastened to the floor.

The invention also relates to a mounting apparatus for mounting a dividing wall, in particular a glass wall or glass panel, on at least one holding device, wherein the mounting apparatus has a mounting system with one of the above mentioned features or a combination of at least two of the above mentioned features. In the mounting apparatus according to the invention, the first mounting device is mounted on the holding device. Furthermore, the second mounting device is mounted on the holding device. The mounting element in turn is arranged on the first mounting device. Furthermore, the clamping holder is arranged on the second mounting device.

The invention furthermore relates to a method for mounting a dividing wall, in particular a glass wall or a glass panel, on a holding device with the use of a mounting system which has one of the above mentioned features or a combination of at least two of the abovementioned features. The method comprises the following steps. The first mounting device is mounted on the holding device. For example, this is undertaken by introduction of a tool into the first mounting opening. The first mounting device is then screwed to the holding device, for example by means of a rotational movement. The method according to the invention furthermore provides mounting of the second mounting device on the holding device. This is undertaken, for example, by introduction of a tool into the second mounting opening. The second mounting device is then screwed to the holding device, for example by means of a rotational movement.

Furthermore, in the method according to the invention, mounting of the mounting element on the first mounting device is provided. This is undertaken, for example, by introduction of the first spherically headed end of the first mounting device into the receptacle and into the holding element section of the mounting element. Furthermore, arrangement of a dividing wall in the receptacle of the mounting element is provided. Furthermore, mounting of the clamping holder on the second mounting device is provided, wherein the dividing wall is clamped between the first clamping part and the second clamping part of the clamping holder. In a particular embodiment, the drilling template is used to produce at least one bore for fastening the holding device to a floor.

The invention also relates to an apparatus for dividing regions, for example a first region from a second region. In particular, this apparatus can be provided to reliably demarcate a region of a swimming pool such that, in particular, small children cannot unintentionally enter the swimming pool. The apparatus is provided with at least one dividing wall, in particular a glass wall or a glass panel. Furthermore, at least one holding device on which the dividing wall is arranged is provided. At least one first mounting device, which is arranged on the holding device, is also provided, wherein the first mounting device has a first end which is provided with a first radius. The apparatus according to the invention also has at least one second mounting device which is arranged on the holding device, wherein the second mounting device has a second end which is provided with a second radius. Furthermore, at least one clamping holder is provided in the apparatus according to the invention, wherein the clamping holder is arranged at the first end of the first mounting device or at the second end of the second mounting device, wherein the clamping holder has a first clamping part and a second clamping part, and wherein the dividing wall is held in a clamping manner between the first clamping part and the second clamping part.

In an embodiment of the apparatus, at least one mounting element is additionally or alternatively provided, which mounting element is arranged on the first mounting device and has a receptacle in which the dividing wall is received in a non-clamping manner, and wherein the receptacle of the mounting element is designed in such a manner that the mounting element is displaceable along the dividing wall which is received in the receptacle. For example, the mounting element has at least one holding element which is designed for arranging the mounting element on the first mounting device. In particular, it is provided that the holding element is designed as a recess in which the first mounting device is arranged. Additionally or alternatively thereto, it is provided that the holding element has at least one guide receptacle and/or a holding element section formed with a radius. Furthermore, it is provided additionally or alternatively thereto that the mounting element is of integral design.

In a further embodiment of the apparatus according to the invention, the first mounting device is of rod-shaped design. Additionally or alternatively thereto, it is provided that the second mounting device is of rod-shaped design. In an, in turn, further embodiment of the invention, the first mounting device has a first spherically headed end. Additionally or alternatively thereto, it is provided that the second mounting device has a second spherically headed end. The design as a spherical head and the corresponding complementary design for receiving the spherical head on the clamping holder make it possible for the clamping holder to be able to be arranged at different angles with regard to a preferred alignment of the first mounting device or of the second mounting device. This ensures a high degree of flexibility in the alignment and arrangement of the dividing wall. It is basically possible, by means of the apparatus according to the invention, to precisely reproduce the profile of a boundary line of a region to be divided off, i.e. to guide the apparatus precisely along the boundary line, specifically irrespective of the geometrical shape of the boundary line.

It is explicitly pointed out that the invention is not restricted to the abovementioned design of the first mounting device and of the second mounting device. On the contrary, the first mounting device and/or the second mounting device may have any suitable design. For example, said devices may be of conical, cylindrical and/or elliptical design.

In a further embodiment of the apparatus according to the invention, it is additionally or alternatively provided that the first mounting device has a first mounting opening for the engagement of a tool. Additionally or alternatively thereto, it is provided that the second mounting device has a second mounting opening for the engagement of a tool.

All of the embodiments discussed here of the apparatus according to the invention have the same advantages as already mentioned further above.

Furthermore, the above invention (i.e. the mounting system, the mounting apparatus, the method and/or the apparatus) has the advantage that, for the clamping of a dividing wall, in particular a glass wall, it is not necessary for the dividing wall to be machined, in particular to have a glass cutout. This is because the dividing wall can be held between the first clamping part and the second clamping part without any machining. In particular, it is not absolutely necessary to drill through the dividing wall, for example a glass wall. The invention therefore in particular also comprises a dividing wall which has not been machined for clamping purposes, and in particular does not have any bores, openings and/or cutouts for clamping purposes.

The invention is explained in more detail below by means of exemplary embodiments with reference to figures, in which FIG. 1 shows a schematic illustration of an apparatus with a dividing wall which is arranged on a first holding device and on a second holding device;

Figure 1:
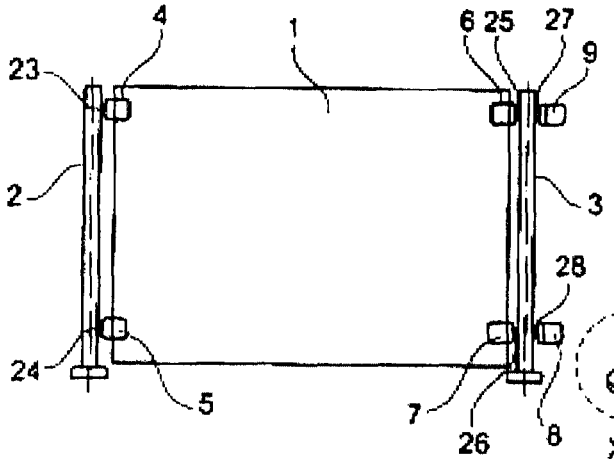
Figure 2:
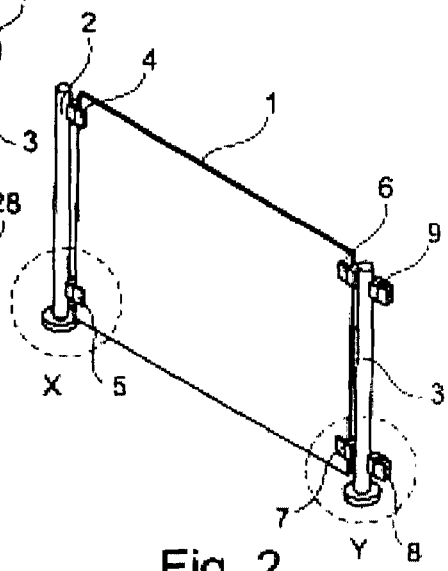
FIG. 2 shows a perspective illustration of the apparatus according to FIG. 1.

FIG. 1 shows a schematic illustration of a dividing wall 1 in the form of a glass panel which is arranged between a first holding device 2 and a second holding device 3. FIG. 2 shows a perspective illustration of the dividing wall 1 which is arranged between the first holding device 2 and the second holding device 3. Both the first holding device 2 and the second holding device 3 are designed as posts, for example as metal posts. The dividing wall 1 is connected to the first holding device 2 and to the second holding device 3 by means of clamping holders. The dividing wall 1 is thus arranged on the first holding device 2 by means of a first clamping holder 4 and a second clamping holder 5. Furthermore, the dividing wall 1 is arranged on the second holding device 3 by means of a third clamping holder 6 and a fourth clamping holder 7. A fifth clamping holder 8 and a sixth clamping holder 9, on which a further dividing wall (not illustrated) can be arranged, are furthermore arranged on the second holding device 3. It is therefore possible to connect numerous dividing walls to one another via holding devices.

In order to arrange the first clamping holder 4 on the first holding device 2, a first mounting device 23 is provided. Approximately the same applies to the further clamping holders. A second mounting device 24 is thus provided for the arrangement of the second clamping holder 5 on the second holding device 2. The third clamping holder 6 is connected to the second holding device 3 via a third mounting device 25. Furthermore, the fourth clamping holder 7 is connected to the second holding device 3 via a fourth mounting device 26. The fifth clamping holder 8 is connected to the second holding device 3 via a sixth mounting device 28. Furthermore, the sixth clamping holder 9 is connected to the second holding device 3 via a fifth mounting device 27. The individual mounting devices will be discussed in more detail further below.

Figure 3:
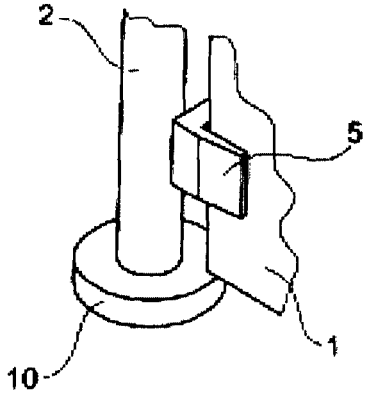
FIG. 3 shows a detailed illustration of the region X according to FIG. 2.
Figure 4:
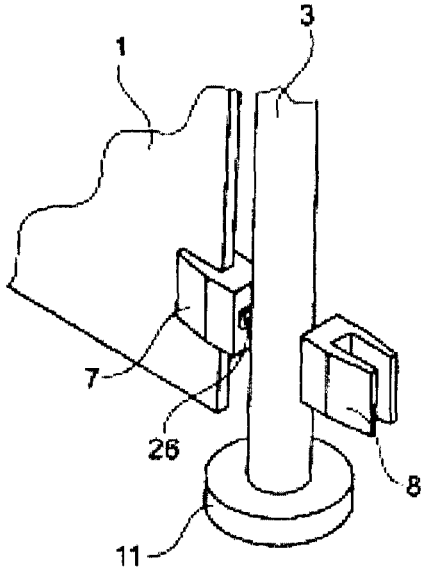
FIG. 4 shows a detailed illustration of the region Y according to FIG. 2.

FIG. 3 shows the region X in FIG. 2 in a detailed illustration. An annular covering 10 which covers a first connecting element for connecting the first holding device 2 to a floor is arranged on the first holding device 2. FIG. 4 shows the region Y in FIG. 2 in a detailed illustration. A second annular covering 11 which covers a second connecting element is arranged on the second holding device 3. The second connecting element serves to connect the second holding device 3 to the floor. The abovementioned is discussed in more detail further below.

Figure 5:
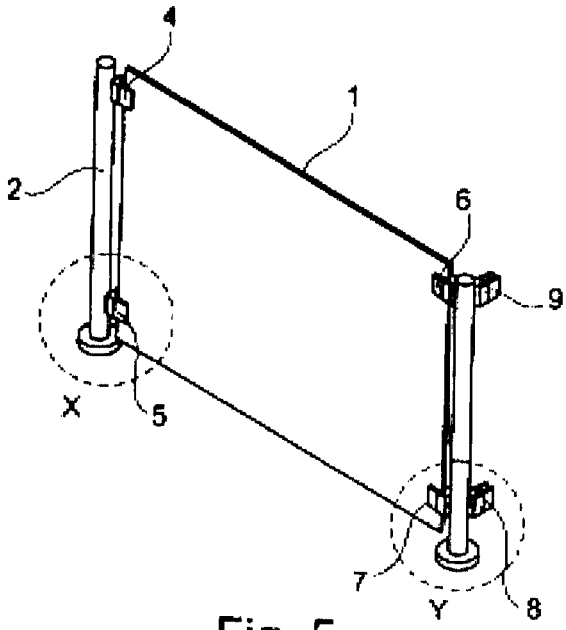
FIG. 5 shows a perspective illustration of a further apparatus with a dividing wall which is arranged on a first holding device and on a second holding device.
Figure 6:
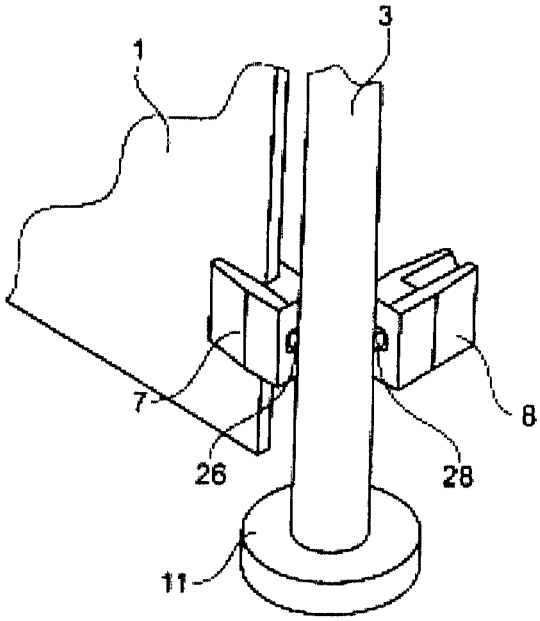
FIG. 6 shows a detailed illustration of the region Y according to FIG. 5.

FIG. 5 shows a perspective illustration of a further embodiment of a fastening of the dividing wall 1, which embodiment is based on the exemplary embodiment in FIGS. 1 to 4. Identical components are therefore provided with the same reference numbers. In contrast to the exemplary embodiment according to FIGS. 1 to 4, the fifth clamping holder 8 and the sixth clamping holder 9 are offset by essentially 90°. Accordingly, the fifth clamping holder 8 and the fourth clamping holder 7 are arranged at an angle of essentially 90° to each other. Furthermore, the sixth clamping holder 9 and the third clamping holder 6 are arranged at an angle of essentially 90° to each other. FIG. 6 shows a more detailed illustration of the region Y in FIG. 5. FIGS. 5 and 6 are intended to clarify that dividing walls can be arranged at different angles to one another. In the embodiment illustrated in FIGS. 5 and 6, this is an angle of essentially 90°. However, it is explicitly pointed out that the invention is not restricted to such an arrangement. On the contrary, the clamping holders on the holding devices 2 and 3 can be arranged at any angle to one another.

Figure 7A:
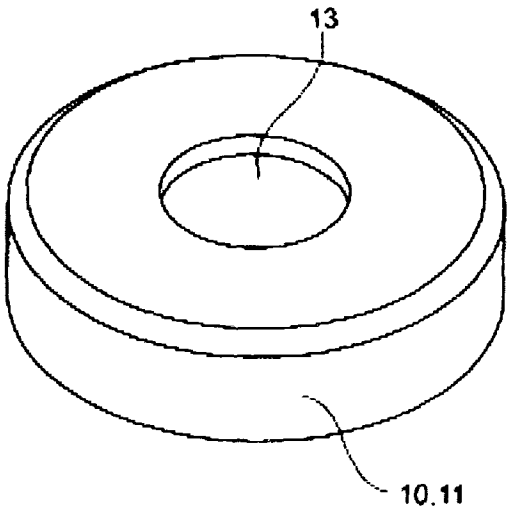
FIG. 7A shows a perspective illustration of an annular covering.
Figure 7B:
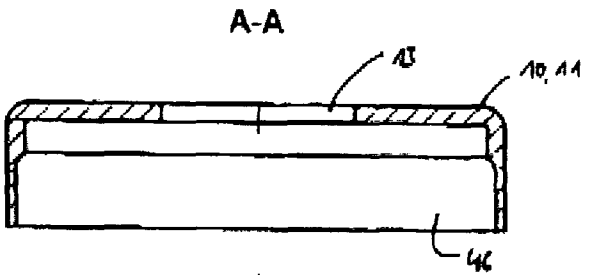
FIG. 7B shows a sectional illustration of the annular covering according to FIG. 7A along the line A-A according to FIG. 7C.
Figure 7C:
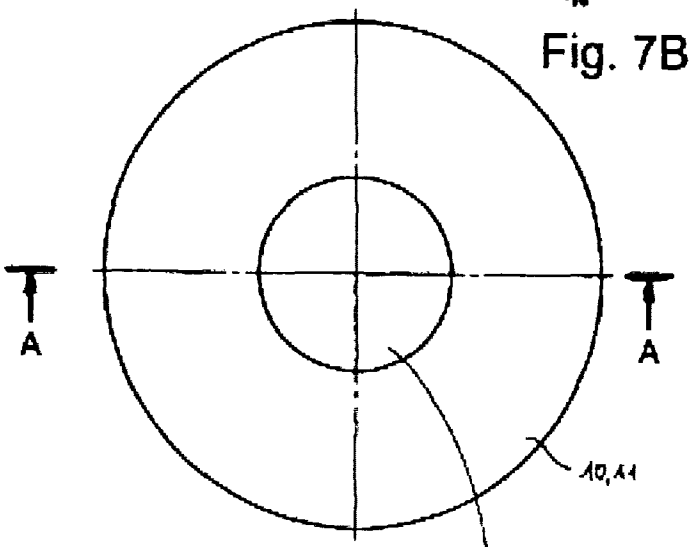
FIG. 7C shows a top view of the annular covering according to FIG. 7A.
Figure 8A:
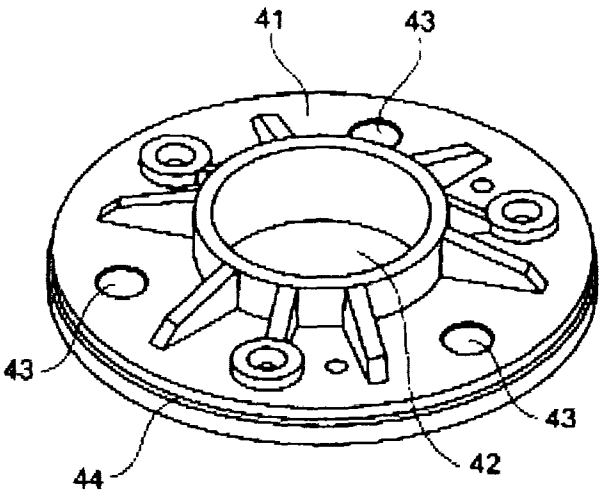
FIG. 8A shows a perspective illustration of a connecting element.
Figure 8B:
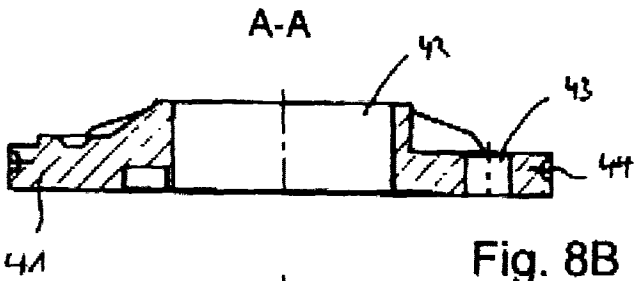
FIG. 8B shows a sectional illustration of the connecting element according to FIG. 8A along the line A-A according to FIG. 8C.
Figure 8C:
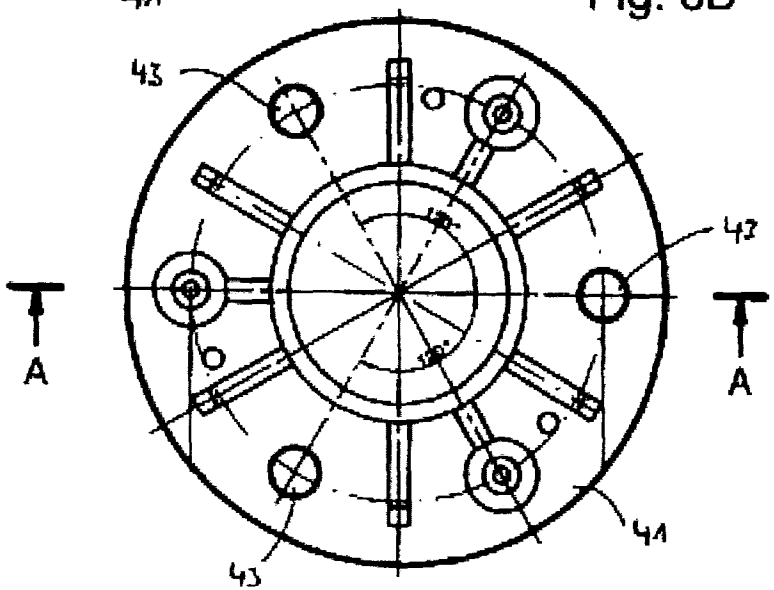
FIG. 8C shows a top view of the connecting element according to FIG. 8A.
Figure 9A:
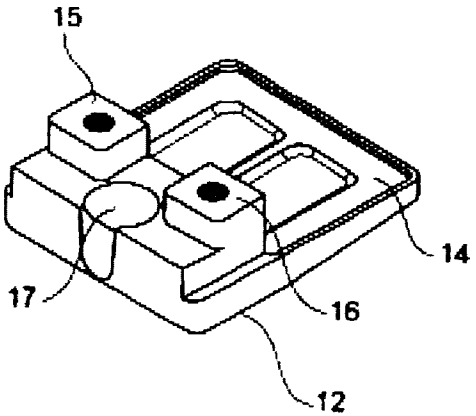
FIG. 9A shows a perspective illustration of a first clamping part of a clamping holder.
Figure 9B:
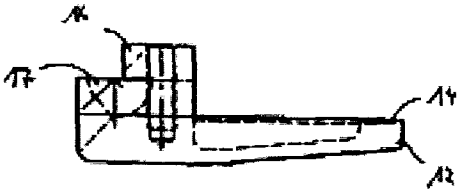
FIG. 9B shows a side view of the first clamping part according to FIG. 9A.
Figure 9C:
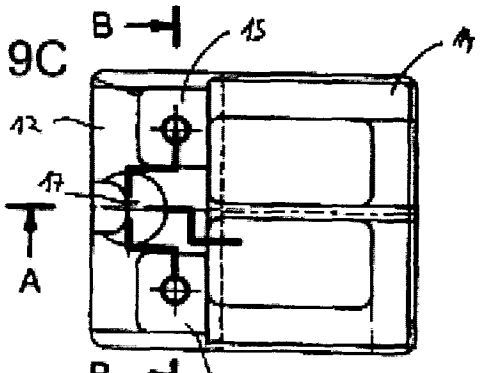
FIG. 9C shows a view, which is tilted through 90° with regard to FIG. 9B, of the first clamping part.
Figure 9E:
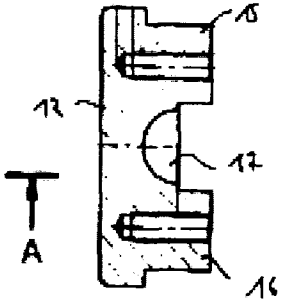
FIG. 9E shows a sectional illustration of the first clamping part along the line B-B according to FIG. 9C.
Figure 9D:
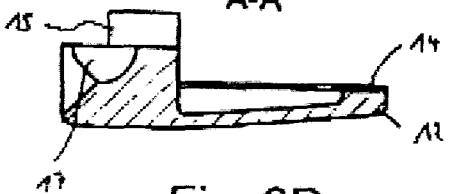
FIG. 9D shows a sectional illustration of the first clamping part along the line A-A according to FIG. 9C.
Figure 10A:
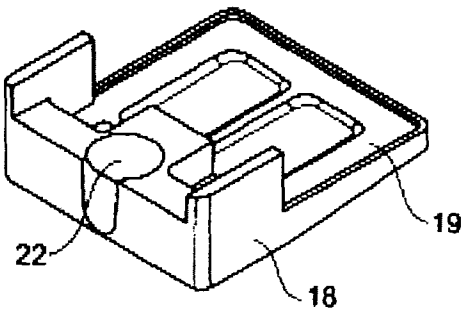
FIG. 10A shows a perspective illustration of a second clamping part of the clamping holder.
Figure 10B:
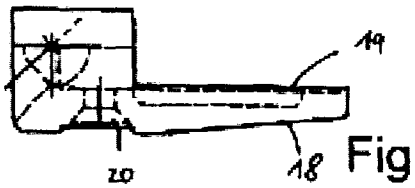
FIG. 10B shows a side view of the second clamping part according to FIG. 10A.
Figure 10C:
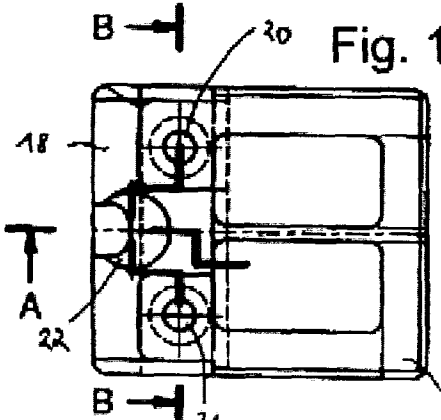
FIG. 10C shows a view, which is tilted through 90° with regard to FIG. 10B, of the second clamping part.
Figure 10E:
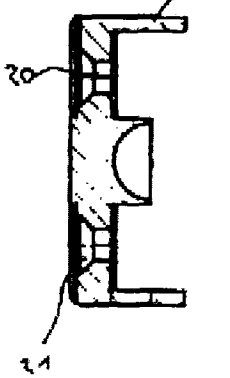
FIG. 10E shows a sectional illustration of the second clamping part along the line B-B according to FIG. 10C.
Figure 10D:
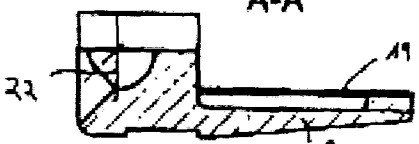
FIG. 10D shows a sectional illustration of the second clamping part along the line A-A according to FIG. 10C.
Figure 11A:
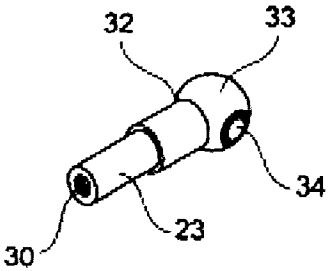
FIG. 11A shows a perspective illustration of a mounting device.
Figure 11C:
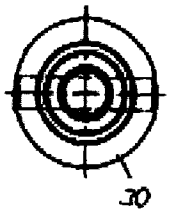
FIG. 11C shows a view, which is tilted through 90° with regard to FIG. 11B, of the mounting device.
Figure 11B:
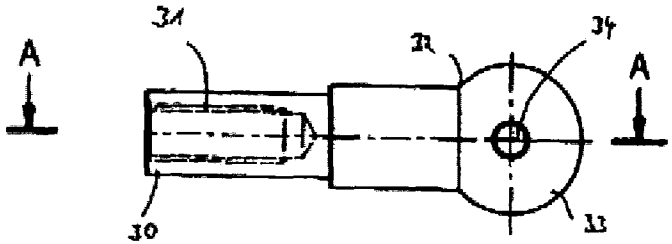
FIG. 11B shows a side view of the mounting device according to FIG. 11A.
Figure 11D:
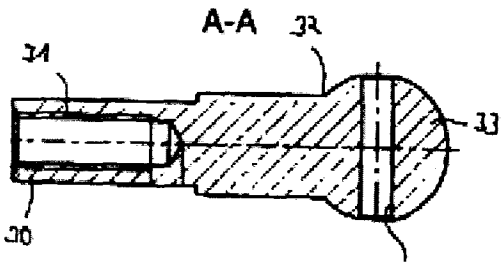
FIG. 11D shows a sectional illustration of the mounting device along the line A-A according to FIG. 11B.
Figure 12A:
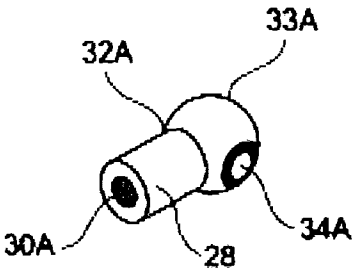
FIG. 12A shows a perspective illustration of a further mounting device.
Figure 12C:
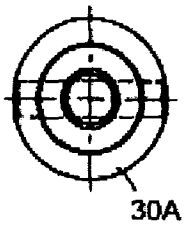
FIG. 12C shows a view, which is tilted through 90° with regard to FIG. 12B, of the further mounting device.
Figure 12B:
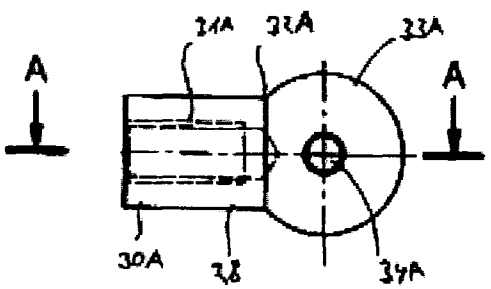
FIG. 12B shows a side view of the further mounting device according to FIG. 12A.
Figure 12D:
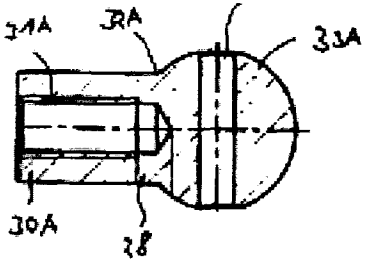
FIG. 12D shows a sectional illustration of the further mounting device along the line A-A according to FIG. 12B.
Figure 13A:
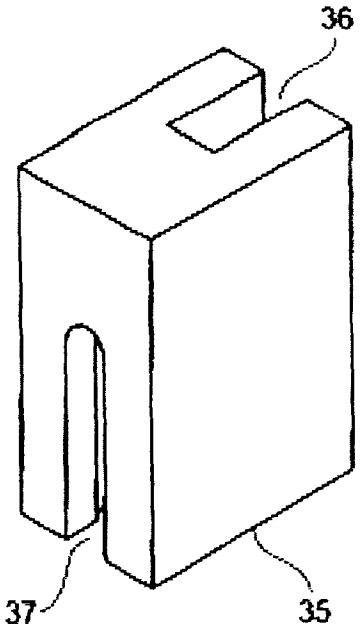
FIG. 13A shows a perspective illustration of a mounting element.
Figure 13C:
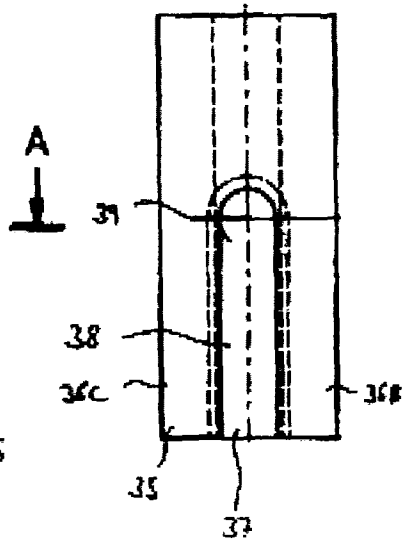
FIG. 13C shows a view, which is tilted through 90° with regard to FIG. 13B, of the mounting element.
Figure 13B:
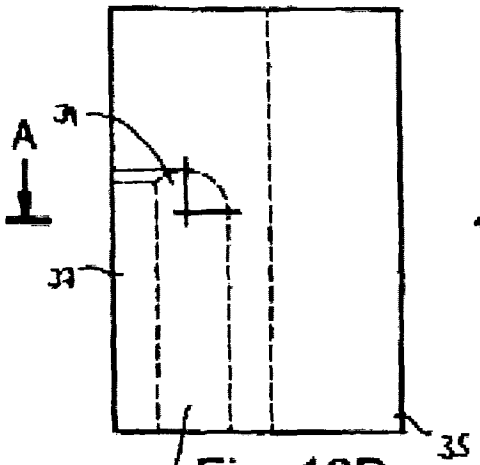
FIG. 13B shows a side view of the mounting element according to FIG. 13A.
Figure 13D:
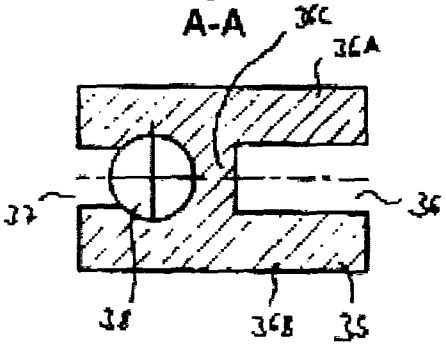
FIG. 13D shows a sectional illustration of the mounting element along the line A-A according to FIG. 13B.

FIGS. 7A to 7C show the formation of the first annular covering 10. The second annular covering 11 is of identical construction. The first annular covering 10 and the second annular covering 11 have an opening 13 through which the first holding device 2 and the second holding device 3 are guided. Both the first annular covering 10 and the second annular covering 11 have respective receiving regions 46 in which the connecting elements already mentioned above are received in such a manner that they are covered by the first annular covering 10 and the second annular covering 11. An embodiment of the first and second connecting elements is illustrated in more detail in FIGS. 8A to 8C. The connecting element is provided with the reference number 41. It has an opening 42 through which the first holding device 2 or the second holding device 3 is guided. Furthermore, the connecting element 41 has three bores 43 which are arranged at an angle of 120° and through which screws can be guided in order to securely connect the connecting element 41 to the floor. A groove 44, in which an elastic ring (not illustrated) is arranged, is arranged on a circumference of the connecting element 41. When the first annular covering 10 or the second annular covering 11 is pulled over the connecting element 41, the first annular covering 10 or the second annular covering 11 is held releasably, but securely, on the connecting element 41.

FIGS. 9A to 9E and 10A to 10E show a detailed illustration of the construction of the first clamping holder 4. It is pointed out that the second to sixth clamping holders 5 to 9 are of identical construction to the first clamping holder 4.

The first clamping holder 4 has a first clamping part 12 which is provided with a first clamping region 14 (cf. FIGS. 9A to 9E). A padded insert made of an elastic material can be arranged in the first clamping region 14. Furthermore, the first clamping part 12 is provided with a first threaded unit 15 and a second threaded unit 16, into which screws can engage. This will be discussed in more detail further on. The first clamping part 12 is furthermore provided with a first receiving section 17 which is of spherical design. The function of the first receiving section 17 is likewise discussed in more detail below.

In addition to the first clamping part 12, the first clamping holder 4 has a second clamping part 18 (cf. FIGS. 10A to 10E). The second clamping part 18 is provided with a second clamping region 19 on which, in turn, a padded inset made of an elastic material can be arranged. Furthermore, the second clamping part 18 is provided with a first bore 20 and a second bore 21. A screw which can engage into the second threaded unit 16 is guidable through the first bore 20. Furthermore, a further screw is guidable into the first threaded unit 15 through the second bore 21. By screwing of the first clamping part 12 to the second clamping part 18, the dividing wall 1 can be clamped and secured in the first clamping region 14 and in the second clamping region 19. The second clamping part 18 is furthermore provided with a second receiving section 22 which is of spherical design. The function of the second receiving section 22 is discussed further below.

The first receiving section 17 of the first clamping part 12 and the second receiving section 22 of the second clamping part 18 serve to receive one of the abovementioned mounting devices, for example the first mounting device 23. It is explicitly pointed out that the second to sixth mounting devices 24 to 28 in FIGS. 1 to 4 are designed identically to the first mounting device 23. The construction of the first mounting device 23 is illustrated in more detail in FIGS. 11A to 11D. The first mounting device 23 is of rod-shaped design. However, it is explicitly pointed out that the invention is not restricted to a rod-shaped design. On the contrary, any possible design may be used. The first mounting device 23 has a first end 30 which is provided with a first threaded section 31. Furthermore, the first mounting device 23 has a second end 32 on which a spherically headed end 33 is formed. The spherically headed end 33 is provided with a first mounting opening 34 in which a tool can engage in order to screw the first mounting device 23 to the first holding device 2.

An exemplary embodiment of the fifth mounting device 27 and of the sixth mounting device 28, as used in the apparatus in FIGS. 5 and 6, is illustrated in FIGS. 12A to 12D. FIGS. 12A to 12D show the sixth mounting device 28. The fifth mounting device 27 is of identical design. The construction of the sixth mounting device 28 basically corresponds to the construction of the first mounting device 23. However, the sixth mounting device 28 is of somewhat shorter design than the first mounting device 23 in order to carry out mounting in a simple manner "diagonally across". The sixth mounting device 28 is also of rod-shaped design. However, it is also explicitly pointed out here that the invention is not restricted to a rod-shaped design. On the contrary, any possible design may be used. The sixth mounting device 28 has a first end 30A which is provided with a first threaded section 31A. Furthermore, the sixth mounting device 28 has a second end 32A on which a spherically headed end 33A is formed. The spherically headed end 33A is provided with a mounting opening 34A in which a tool can engage in order to screw the sixth mounting device 28 to the second holding device 3.

With regard to the exemplary embodiment according to FIGS. 1 to 4, the spherically headed end 33 is receivable in the first receiving section 17 of the first clamping part 12 of the first clamping holder 4 and in the second receiving section 22 of the second clamping part 18 of the first clamping holder 4. The same applies to the second to sixth clamping holders 5 to 9 in FIGS. 1 to 4.

With regard to the exemplary embodiment according to FIGS. 5 and 6, approximately the same applies to the spherically headed end 33A. The latter, in the exemplary embodiment according to FIGS. 5 and 6, is receivable in the first receiving section 17 of the first clamping part 12 of the fifth clamping holder 8 (or of the sixth clamping holder 9) and in the second receiving section 22 of the second clamping part 18 of the fifth clamping holder 8 (or of the sixth clamping holder 9).

FIGS. 13A to 13D show a mounting element 35 which is provided for mounting the dividing wall 1 on the first holding device 2 and on the second holding device 3. The mounting element 35 is of integral design and is formed from plastic. However, it is explicitly pointed out that the invention is not restricted to a single-piece design. On the contrary, embodiments in which the mounting element 35 is of multi-piece design are also provided. Completely different materials may also be used for forming the mounting element 35.

The mounting element 35 has a receptacle 36. The receptacle 36 is of U-shaped design. It has a first limb 36A, a second limb 36B and a base 36C which is arranged between the first limb 36A and the second limb 36B. A dividing wall 1 which is receivable and is arranged in the receptacle 36 is surrounded by the first limb 36A and the second limb 36B, but not, as already explained above, in a clamping manner. It only ensures that the dividing wall 1 is reliably guided and is not unintentionally removable from the receptacle 36 of the mounting element 35. Clamping, i.e. fixing, of the dividing wall 1 in such a manner that the latter can no longer be moved is not possible by the mounting element 35. This differentiates the mounting element 35 from a clamping device which is known from the prior art and in which a dividing wall is clamped and fixed between two clamping parts such that it can no longer move.

Furthermore, the mounting element 35 has a recess 37 which has a slot-shaped guide receptacle 38 and a holding section 39 formed with a radius. The radius of the holding section 39 is formed in a complementary manner to the radius of the spherically headed end 33 or 33A. This means that the radius of the holding section 39 is formed in such a manner that the spherically headed end 33 or 33A of each mounting device mentioned above can be securely mounted in the holding section 39.

Figure 14A:
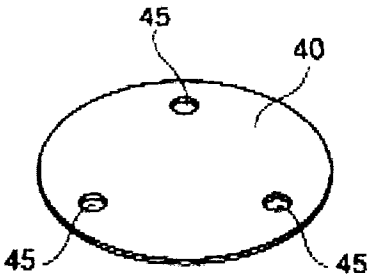
FIG. 14A shows a perspective illustration of a drilling template.
Figure 14C:
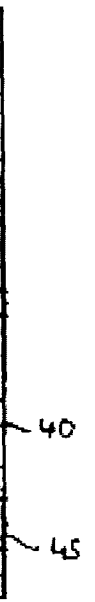
FIG. 14C shows a sectional illustration of the drilling template along the line A-A according to FIG. 14B.
Figure 14B:
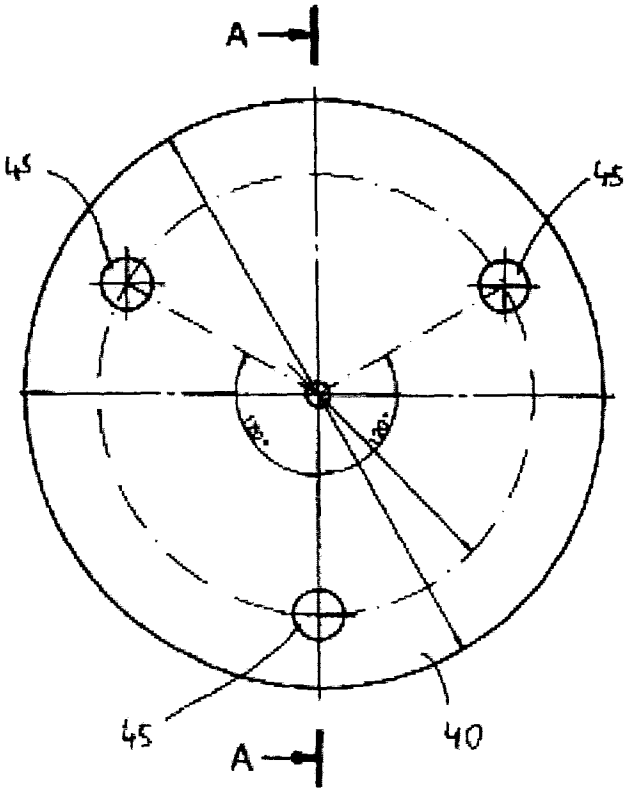
FIG. 14B shows a top view of the drilling template according to FIG. 14A.
Figure 15:
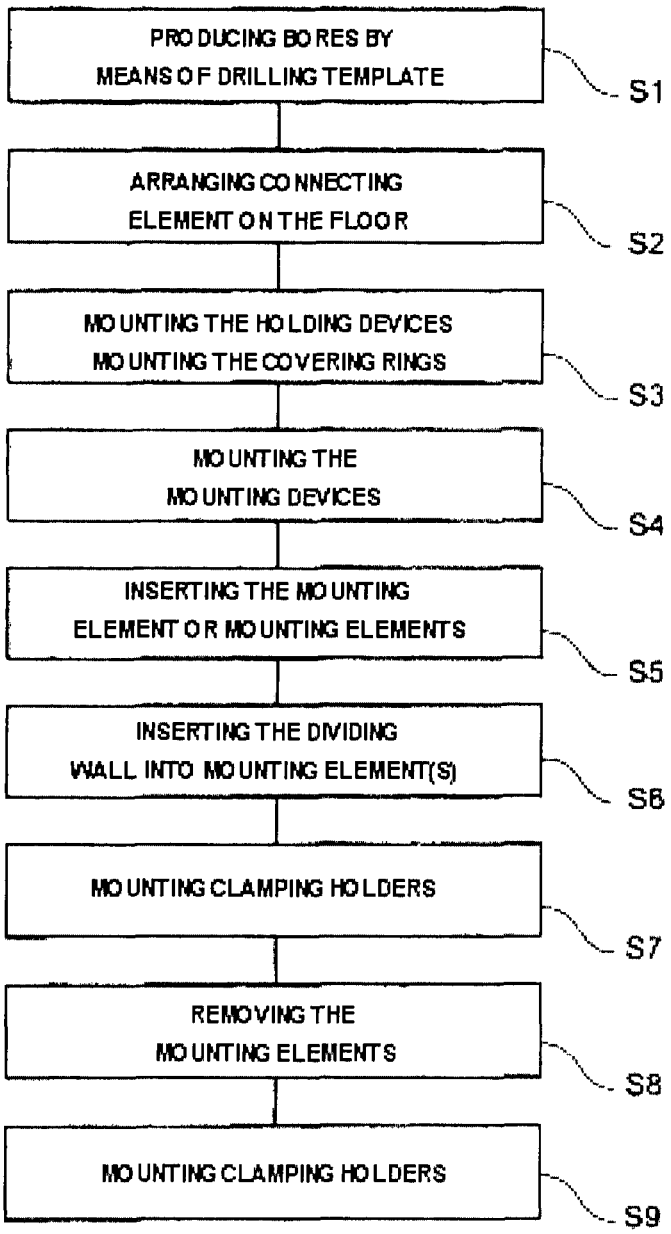
FIG. 15 shows a sequence of a method according to the invention.

The mounting of the dividing wall 1 on the first holding device 2 and on the second holding device 3 is now described in more detail below with reference to FIG. 15. First of all, in a method step S1, holes are drilled in a floor by means of a drilling template. The use of a drilling template is advantageous, since the holes can be placed precisely. An exemplary embodiment of a drilling template is illustrated in FIGS. 14A to 14C. The drilling template is provided with the reference number 40. Holes 45 in the drilling template 40 mark the positions at which the bores are carried out. A drill is correspondingly guided through the holes 45 in order to produce the bores. In method step S1, bores are produced both for the connecting element 41 of the first holding device 2 and for the connecting element 41 of the second holding device 3.

In a further method step S2, both the connecting element 41 of the first holding device 2 and the connecting element 41 of the second holding device 3 are fastened to the floor by means of screws. The first holding device 2 and the second holding device 3 are subsequently inserted into the corresponding connecting element 41 (method step S3). The first annular covering 10 is then arranged on the connecting element 41 of the first holding device 2 in such a manner that the connecting element 41 is concealed. Furthermore, the second annular covering 11 is arranged on the connecting element 41 of the second holding device 3 in such a manner that the connecting element 41 is concealed (method step S3).

The first mounting device 23 and the second mounting device 24 are then mounted on the first holding device 2 (method step S4). This is undertaken by introduction of a tool into the mounting opening 34 in the first mounting device 23 or second mounting device 24. By means of a rotational movement, the first mounting device 23 or the second mounting device 24 is screwed to a corresponding thread arranged on the first mounting device 2. The same applies to the third mounting device 25 and the fourth mounting device 26

(method step S4). Said mounting devices are mounted on the second holding device 3. A tool is introduced into the mounting opening 34 in the third mounting device 25 or the fourth mounting device 26. By means of a rotational movement, the third mounting device 25 or the fourth mounting device 26 is screwed to a corresponding thread arranged on the second holding device 3.

In a further method step S5, the mounting element 35 is now arranged on the first mounting device 23. This is undertaken by introduction of the spherically headed end 33 of the first mounting device 23 into the receptacle 37 and mounting of the spherically headed end 33 of the first mounting device 23 in the holding section 39 of the mounting element 35. Furthermore, a further mounting element 35 which is of identical construction to the above mentioned mounting element 35 is arranged on the third mounting device 25. This is undertaken by introduction of the spherically headed end 33 of the third mounting device 25 into the receptacle 37 and mounting of the spherically headed end 33 of the third mounting device 25 in the holding section 39 of the further mounting element 35.

The dividing wall 1 is subsequently arranged between the first holding device 2 and the second holding device 3 in such a manner that the dividing wall 1 is arranged by one edge in each case in the receptacles 36 of the two abovementioned mounting elements 35 (method step S6). In the process, the dividing wall 1 is in each case surrounded in each receptacle 36 of the two above mentioned mounting elements 35 by the first limb 36A and the second limb 36B, but—as already explained above—in a non-clamping manner. Reference is made in this respect explicitly to the abovementioned comments.

In a further method step S7, the second clamping holder 5 is now mounted on the second mounting device 24. This is undertaken by arranging the spherically headed end 33 of the second mounting device 24 in the first receiving section 17 of the first clamping part 12 of the second clamping holder 5 and in the second receiving section 22 of the second clamping part 18 of the second clamping holder 5. The first clamping part 12 and the second clamping part 18 of the second clamping holder 5 are subsequently screwed to each other in such a manner that the dividing wall 1 is held in a clamping manner. Furthermore, the fourth clamping holder 7 is now mounted on the fourth mounting device 26. This is undertaken by arranging the spherically headed end 33 of the fourth mounting device 26 in the first receiving section 17 of the first clamping part 12 of the fourth clamping holder 7 and in the second receiving section 22 of the second clamping part 18 of the fourth clamping holder 7. The first clamping part 12 and the second clamping part 18 of the fourth clamping holder 7 are then screwed to each other in such a manner that the dividing wall 1 is held in a clamping manner.

In method step S8, the two mounting elements 35 are then removed again. For this purpose, the respective mounting element 35 is displaced vertically upward along the edge of the dividing wall 1. By this means, the spherically headed end 33 of the first mounting device 23 is removed from the holding section 39 of the mounting element 35. Furthermore, the spherically headed end 33 of the third mounting device 25 is removed from the holding section 39 of the further mounting element 35.

In a further method step S9, the first clamping holder 4 is now mounted on the first mounting device 23. This is undertaken by arranging the spherically headed end 33 of the first mounting device 23 in the first receiving section 17 of the first clamping part 12 of the first clamping holder and in the second receiving section 22 of the second clamping part 18 of the first clamping holder 4. The first clamping part 12 and the second clamping part 18 of the first clamping holder 4 are subsequently screwed to each other in such a manner that the dividing wall 1 is held in a clamping manner. Furthermore, the third clamping holder 6 is now mounted on the third mounting device 25. This is undertaken by arranging the spherically headed end 33 of the third mounting device 25 in the first receiving section 17 of the first clamping part 12 of the third clamping holder 6 and in the second receiving section 22 of the second clamping part 18 of the third clamping holder 6. The first clamping part 12 and the second clamping part 18 of the third clamping holder 6 are then screwed to each other in such a manner that the dividing wall 1 is held in a clamping manner.

The invention has the advantage that, owing to the mounting element 35, it is possible in a simple manner first of all to releasably fix the dividing wall 1 and to arrange the latter at a predeterminable position between the first holding device 2 and the second holding device 3. Furthermore, it is ensured that the mounting of the dividing wall 1 on the first holding device 2 and the second holding device 3 can now be carried out in a simple manner by just one person by means of clamping holders.

The design as a spherical head in the mounting devices and the corresponding complementary design for receiving the spherical head on the individual clamping holders mentioned above make it possible for the individual clamping holders to be able to be arranged at different angles with respect to a preferred alignment of the abovementioned mounting devices. This ensures a high degree of flexibility in the alignment and arrangement of the dividing wall 1. It is basically possible, by means of the apparatus according to the invention, to precisely reproduce the profile of a boundary line of a region to be divided off, i.e. to guide the apparatus precisely along the boundary line, specifically irrespective of the geometrical shape of the boundary line.

Furthermore, in all of the exemplary embodiments illustrated, it is not necessary, in order to clamp the dividing wall 1, in particular a glass wall, for the dividing wall 1 to be machined, and in particular to have a glass cutout. This is because the dividing wall 1 can be held without any machining between the first clamping part 12 and the second clamping part 18 of each of the above mentioned clamping holders. In particular, it is not absolutely necessary to drill through the dividing wall 1, for example a glass wall, and/or to provide said dividing wall with openings and/or with cutouts.

LIST OF REFERENCE NUMBERS

1 Dividing wall
2 First holding device
3 Second holding device
4 First clamping holder
5 Second clamping holder
6 Third clamping holder
7 Fourth clamping holder
8 Fifth clamping holder
9 Sixth clamping holder
10 First annular covering
11 Second annular covering
12 First clamping part
13 Opening
14 First clamping region
15 First threaded unit
16 Second threaded unit
17 First receiving section
18 Second clamping part

19 Second clamping region
20 First bore
21 Second bore
22 Second receiving section
23 First mounting device
24 Second mounting device
25 Third mounting device
26 Fourth mounting device
27 Fifth mounting device
28 Sixth mounting device
29
30 First end
30A First end
31 Threaded section
31A Threaded section
32 Second end
32A Second end
33 Spherically headed end
33A Spherically headed end
34 Mounting opening
35 Mounting element
36 Receptacle
36A First limb
36B Second limb
36C Base
37 Recess
38 Guide receptacle
39 Holding section
40 Drilling template
41 Connecting element
42 Opening
43 Bore
44 Groove
45 Bore
46 Receiving region

The invention claimed is:

1. An apparatus for dividing regions, comprising:

at least one glass dividing wall (1);

at least one holding device (2, 3) on which the dividing wall (1) is arranged;

at least one first mounting device (23 to 28) which is arranged on the holding device (2, 3), wherein the first mounting device (23 to 28) has a first end (32, 32A) which is provided with a first radius (33, 33A), wherein the first end (32, 32A) is a first spherically headed end (33, 33A);

at least one second mounting device (23 to 28) which is arranged on the holding device (2, 3), wherein the second mounting device (23 to 28) has a second end (32, 32A) which is provided with a second radius (33, 33A), wherein the second end (32, 32A) is a second spherically headed end (33, 33A); and at least one clamping holder (4 to 9), wherein the clamping holder (4 to 9) is arranged at one of the ends of one of the mounting devices, wherein the clamping holder (4 to 9) has a first clamping part (12) and a second clamping part (18), and wherein the dividing wall (1) is clamped between the first clamping part (12) and the second clamping part (18).

2. The apparatus as claimed in claim 1, wherein at least one of the mounting devices is rod-shaped.

3. The apparatus as claimed in claim 1 wherein at least one of the mounting devices has a mounting opening for the engagement of a tool.

4. The apparatus as claimed in claim 1, wherein the apparatus has at least one mounting element (35) which is arranged on the first mounting device (23 to 28) and has a receptacle (36) in which the dividing wall (1) is received in a non-clamping manner, and wherein the receptacle (36) of the mounting element (35) permits the mounting element to be displaced along the dividing wall.

5. The apparatus as claimed in claim 4, wherein the mounting element (35) has at least one holding element (37, 38, 39) for arranging the mounting element (35) on the first mounting device (23 to 28).

6. The apparatus as claimed in claim 5, wherein the holding element has a recess (37, 38, 39) in which the first mounting device (23 to 28) is arranged.

7. The apparatus as claimed in claim 5, wherein the holding element has at least one guide receptacle (37, 38) and a holding element section (39) having a radius.

8. The apparatus as claimed in claim 5, wherein the holding element has at least one guide receptacle (37, 38) or a holding element section (39) having a radius.

9. The apparatus as claimed in claim 4, wherein the mounting element (35) is of integral design.

* * * * *